US006337617B1

(12) United States Patent
Kato et al.

(10) Patent No.: US 6,337,617 B1
(45) Date of Patent: Jan. 8, 2002

(54) IGNITION COIL DEVICE HAVING SPOOL INCLUDING GLASS FIBER AND SILICA

(75) Inventors: Katsuhisa Kato; Kazuhide Kawai, both of Kariya; Kazutoyo Osuka, Gamagori; Hiroyuki Wakabayashi, Kariya; Hideki Oka, Okazaki, all of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/460,242

(22) Filed: Dec. 13, 1999

(30) Foreign Application Priority Data

Feb. 19, 1999 (JP) ..... 11-041651

(51) Int. Cl.[7] ..... H01F 27/02
(52) U.S. Cl. ..... 336/96; 336/92; 336/90
(58) Field of Search ..... 336/90, 92, 96, 336/205, 107, 198; 123/634, 635; 524/493, 494

(56) References Cited

U.S. PATENT DOCUMENTS 3,478,290 A * 11/1969 Proxmire ..... 336/205
5,412,024 A * 5/1995 Okada et al. ..... 524/577
5,632,259 A * 5/1997 Konda et al. ..... 123/634
5,663,276 A * 9/1997 Yoneta et al. ..... 528/194
5,778,863 A * 7/1998 Oosuka et al. ..... 123/634
5,804,634 A * 9/1998 Umetsu et al. ..... 524/466

FOREIGN PATENT DOCUMENTS

| | | |
|---|---|---|
| JP | 7-169622 | 7/1995 |
| JP | 11-26266 | 9/1998 |
| JP | 10-289831 | 10/1998 |

OTHER PUBLICATIONS

U.S. application No. 09/023613, Osuka et al., filed Feb. 13, 1998.

* cited by examiner

*Primary Examiner*—Anh Mai
(74) *Attorney, Agent, or Firm*—Nixon & Vanderhye PC

(57) ABSTRACT

In a stick-type ignition coil device for engines, a primary spool is disposed outside a secondary coil. The primary spool is made of PBT (polybuthylene telephthalate) having a low melting viscosity and a high flowability as a resin base material. The resin base material is admixed with an olefin rubber in 5 wt. %, glass fibers in 12.5 wt. % and silica in 12.5 wt. %. A primary coil 24 comprises a wire body coated with PET (polyethylene telephthalate), silicone or wax as a separating member, and is wound around the primary spool. The growth of trees in the primary spool 23 restricted even when electrical discharges occur between a secondary coil and the primary coil and the primary spool is eroded by the electrical discharges, because silica is added in the primary spool.

25 Claims, 3 Drawing Sheets

| | PRIMARY SPOOL | | | COIL SIZE | COIL LIFE |
|---|---|---|---|---|---|
| | BASE | RUBBER | INORGANIC FILLER | | |
| EMBODIMENT | PBT | OLEFIN RUBBER 5wt.% | GLASS FIBERS 12.5wt.% SILICA 12.5wt.% | φ25 | ○ |
| EXAMPLE 1 | PBT | OLEFIN RUBBER 5wt.% | GLASS FIBERS 25wt.% | φ25 | × (DIELECTRIC BREAKDOWN IN SPOOL) |
| EXAMPLE 2 | PBT | OLEFIN RUBBER 5wt.% | SILICA 25wt.% | φ25 | × (CRACK IN SPOOL) |

IGNITION COIL DEVICE HAVING SPOOL INCLUDING GLASS FIBER AND SILICA

CROSS REFERENCE TO RELATED APPLICATION

This application relates to and incorporates herein by reference Japanese Patent Application No. 11-41651 filed on Feb. 19, 1999.

BACKGROUND OF THE INVENTION

1. Field of the Invention

The present invention relates to a stick-type ignition coil device which is directly mountable in a plug hole of an internal combustion engine.

2. Related Art

Stick-type ignition coil devices as proposed in JP-A10-289831 (U.S. patent application Ser. No. 09/023,613 filed Feb. 13, 1998) must be sized under the limitation that it is fitted in a narrow plug hole of an internal combustion engine. A resinous insulating material fills in the ignition coil device to ensure electrical insulation between various members closely disposed in the ignition coil device. Spools for windings are shaped in an elongated cylindrical form and disposed coaxially around a stick-shaped central core. Each spool is preferably as thin as possible not to enlarge the outer diameter of the ignition coil device. Glass fibers are admixed in a resin base material as a reinforcing material to restrict plastic deformation of thinned spools. Further, a rubber material may be admixed in the resin base material to increase toughness of the spool.

However, micro voids tend to occur around the glass fibers due to difference in the linear thermal expansion coefficients between the resinous base material and the glass fibers, when the spool is molded from an admixture of the resinous base material and the glass fibers. Further, the rubber material which has a lower thermal decomposition temperature tends to sublimate due to electrical discharges to cause voids, if the rubber material is admixed in the resin base material. These voids will enable the discharges to occur from the surface of the spool to the voids, thus causing treeing which is a kind of dielectric breakdown. If treeing grows to cause the dielectric breakdown in the spool, the spool will lose its insulating function. If treeing further passes through the resinous insulating material and grows to bridge a high voltage part and a low voltage part in the ignition coil device, a secondary coil of the ignition coil device will be unable to generate a required high voltage.

Further, because the resinous insulating material not only ensures electrical insulation but also cements the various members to one another, the members having different linear thermal expansion coefficients are subjected to restraining forces when expanding and contracting in accordance with changes in surrounding temperature. Thus, the spool tend to distort and tend to crack in the end. Cracks in the spool will cause electrical discharges between adjacent coil wires.

It has therefore been proposed to wind a thin film around the outer periphery of the spool, or to coat the coil wires for enabling a separation between the thin film and the resinous insulating material cementing the coil or for enabling a separation between the coated coil and the resinous insulating material. Thus, the inner peripheral side and the outer peripheral side of the ignition coil can expand and contract independently of each other thereby restricting spool cracking.

However, the electrical discharge concentrates in the voids caused by the separation, thus causing erosion locally on the surface of the spool. The local erosion will enable treeing to grow, resulting in the dielectric breakdown of the spool. Although the continuous part of the thin film is less likely to be eroded by the electrical discharge, the spool is still possibly eroded by the electrical discharge passing through connection parts of the thin film.

SUMMARY OF THE INVENTION

It is therefore an object of the present invention to provide an ignition coil device that is capable of restricting treeing caused by electrical discharges in a spool from growing.

According to the present invention, an ignition coil device for internal combustion engines includes a stick-type core, a primary spool disposed coaxially with the core, a primary coil wound around the primary spool, a secondary spool disposed coaxially with the core, a secondary coil wound around the secondary spool, and a resinous insulating material filling a space in those parts. At least one of the spools located between the primary coil and the secondary coil is made of a resin base material admixed with glass fibers and silica. The glass fibers restricts plastic deformation of the spool and silica restrict a growth of treeing in the spool caused by electrical discharges.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
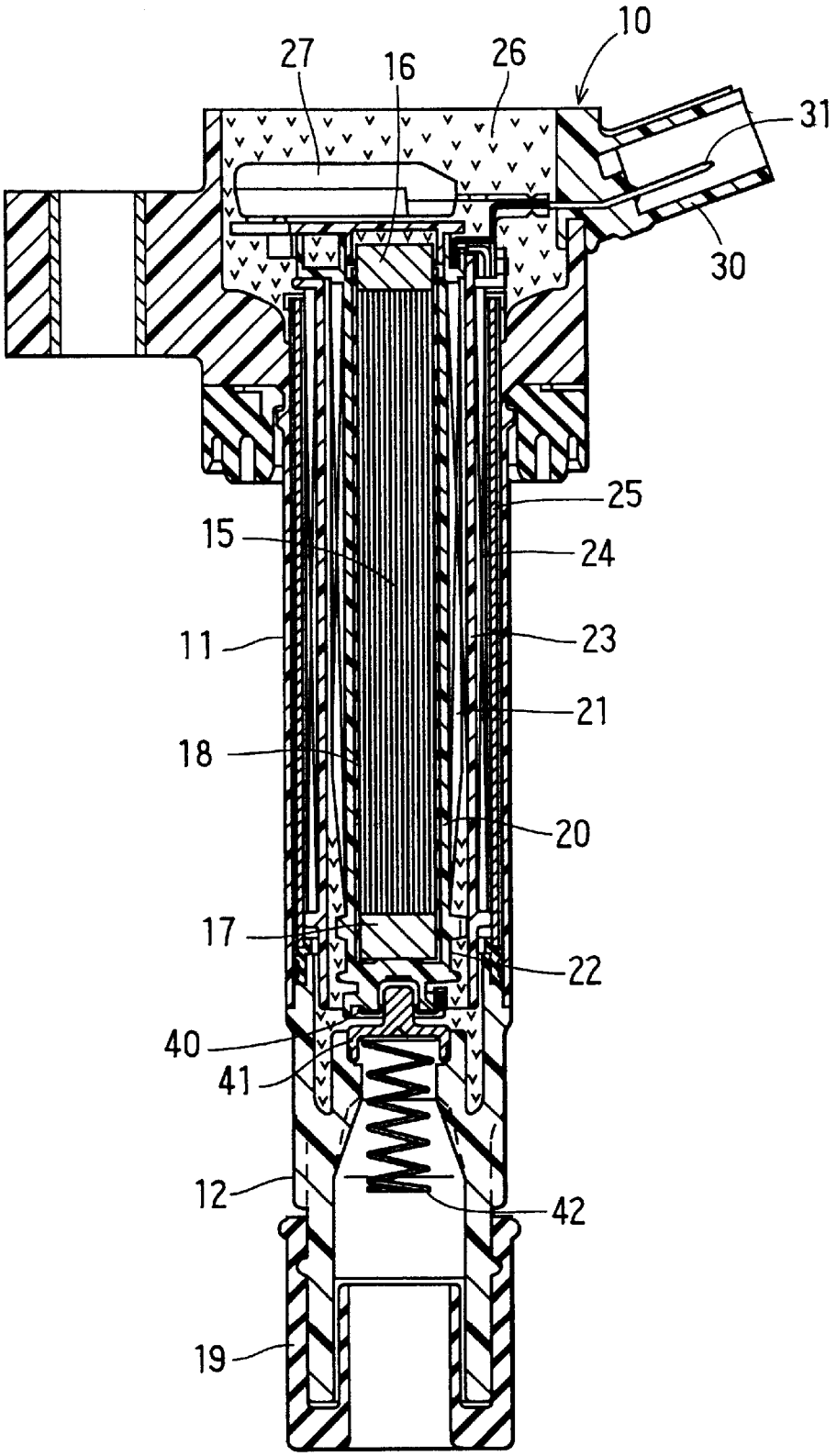
FIG. 1 is a sectional view showing an ignition coil device according to an embodiment of the present invention.

Referring first to FIG. 1, an ignition coil device 10 is constructed as a stick-type for mounting in a plug hole in an internal combustion engine (not shown) and is electrically connectable to a spark plug (not shown) at its lower side.

The ignition coil device 10 comprises a coil casing 11 and a high voltage tower 12 both of which are made of a resin material and in a cylindrical shape. The coil casing 11 accommodates therein a central core 15, permanent magnets 16, 17, a secondary spool 20, a secondary coil 21, a primary spool 23, a primary coil 24 an outer core 25 and the like. An epoxy resin 26 fills spaces in the coil casing 11 and the high voltage tower 12 to electrically insulate the component parts accommodated therein.

The central core 15 is made of thin silicon steel plates stacked in the radial direction to provide a stick-type cylindrical shape. The permanent magnets 16, 17 are positioned at the top side and the bottom side of the central core 15. The permanent magnets 16, 17 are magnetized in the polarities which are opposite to the direction of magnetic flux generated upon energization of the primary coil 23, so that the output voltage generated by the secondary coil 21 increases. A cylindrical rubber member 18 surrounds the outer peripheral surface of the central core 15.

Figures 2, 3:
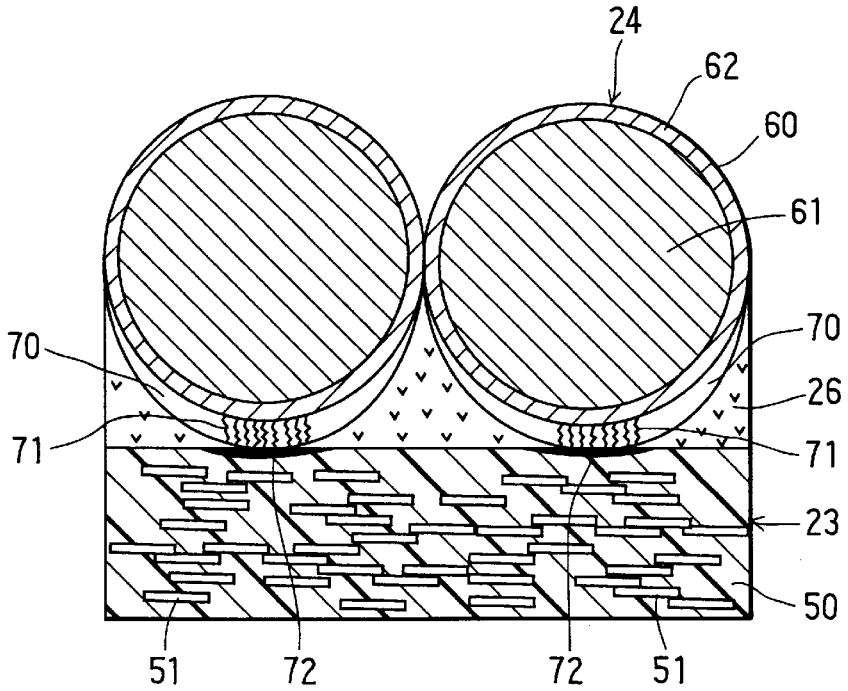
FIG. 2 is a schematic sectional view showing a mode of separation between a primary coil and a primary spool in the embodiment of FIG. 1.
FIG. 3 is a table showing a result of experiments conducted on the embodiment shown in FIG. 1 and comparative examples.

The primary spool 23 is made of a resin material and disposed outside the secondary spool 21. Specifically, as shown in FIG. 2, the resin material for the primary spool 23 includes a base material 50 such as PBT (polybutylene terephthalate resin) which has a low melting viscosity and a high flowability for molding. The PBT is added with an olefin rubber (not shown) in 5 wt. %, glass fibers 51 in 12.5 wt. % and granular silica (not shown) in 12.5 wt. %. The glass fibers 51 are admixed to restrict plastic deformation of the primary spool 23. The olefin rubber is admixed to increase toughness of the primary spool 23. The silica is admixed to restrict growth of treeing in the primary spool 23. Acrylic rubber or any other rubber may alternatively be used in place of the olefin rubber to increase the toughness of the primary spool 23.

The primary coil 24 is constructed by winding an electrical coil wire 60 which comprises a wire body 61 and a separating material 62 coated around the wire body 61 around the outer periphery of the primary spool 23. The separating material 62 may be PET (polyethylene terepthalate), silicone, wax or the like which has an electrical insulating property.

The secondary spool 20 is disposed outside the rubber member 18 and made of a resin material. The secondary spool 20 may be molded from the same composition as the primary spool 23 or from the similar composition which does not include silica as opposed to the primary spool 23. The secondary coil 21 is wound around the secondary spool 20. A dummy coil 22 is wound some turns at the high voltage side of the secondary coil 21. The dummy coil 22 connects the secondary coil 21 to a terminal plate 40. Because the secondary coil 21 and the terminal plate 40 are electrically connected not via a single straight wire but via the dummy coil 22, the surface area of contact between the secondary coil 21 and the terminal plate 40 increases thereby to reduce the concentration of the electric field on the electrical connection part.

The outer core 25 is disposed outside the primary coil 24. The outer core 25 is made of a thin silicon steel plate wound cylindrically. The winding start part and the winding end part of the steel plate are not connected, so that the outer core 25 had an inner spacing in the axial direction. The outer core 25 extends axially from a position adjacent to the outer periphery of the permanent magnet 16 to a position adjacent to the outer periphery of the permanent magnet 17.

An electrical connector 30 is fitted with the coil casing 11 and protrudes outwardly in a manner that it is connectable at the outside of the plug hole. The connector 30 includes a plurality of insert-molded terminal pins which are connected to a built-in igniter circuit 27 and to the ground sides of the primary coil 24 and the secondary coil 21. The igniter 27 is disposed atop the coil casing 11 for switching on or off the primary current supplied to the primary coil 24. The terminal pins 31, the igniter 27, the primary coil 24 and the secondary coil 21 are connected electrically through electrical lead wires.

The high voltage terminal 41 is press-fit into the high voltage tower 12. The terminal plate 40 has a nail part at its central location to receive the high voltage terminal 41. With the top end of the high voltage terminal 41 being inserted into the nail part of the terminal plate 40, secondary coil 21 is electrically connected to the high voltage terminal 41 through the terminal plate 40. The high voltage side of the dummy coil 22 is electrically connected to the terminal plate 40 by fusing or soldering. A spring 42 is accommodated within the high voltage tower 12 and electrically connected to the high voltage terminal 41 at its one end. The spring 42 is electrically connectable to a spark plug at its other end, when the ignition coil device 10 is fitted in the plug hole. A plug cap 19 made of a rubber is fitted around an open side of the high voltage tower 12. The plug cap 19 is fitted around the spark plug.

The secondary coil 21 generates a high voltage when the primary current flowing in the primary coil 24 is switched off by the igniter circuit 27. This high voltage is applied to the spark plug through the dummy coil 22, the terminal plate 40, the high voltage terminal 41 and the spring 42.

In the above embodiment, the linear thermal expansion coefficients of the wire body 61 of the primary coil 24, the epoxy resin 26 and the resin base material 50 of the primary spool 23 are different one another. Further, the epoxy resin 26 is cemented to the primary spool 23, and the separating material 62 coated on the wire body 61 is easily separable from the epoxy resin 26. Therefore, when those members repeat expansions and contractions in correspondence with changes in the surrounding temperature of the ignition coil device 10, the coil wire 60 and the epoxy resin 26 tend to separate thus causing voids 70 therebetween as shown in FIG. 2.

As a result, electrical discharges 71 tend to occur in the voids 70 due to the potential difference between the primary coil 24 which has a low potential and the secondary coil 21 which is located radially inside the primary coil 24 and has a high potential. When the electrical discharges 71 occur, the resin base material 50 of the primary spool 23 existing between the primary coil 24 and the secondary coil 21 sublimates at the side of the primary coil 24. Thus, erosion 72 occurs causing the electrical discharge 71 to concentrate thereat. Although the glass fibers 51 are used to restrict the plastic deformation of the primary spool 23, voids (not shown) occur around the glass fibers 51 due to the difference in the linear thermal expansion coefficients of the resin base material 50 and the glass fibers 51 when the spool 23 is molded. The electrical discharges 71 tend to be directed from the erosion 72 to the voids around the glass fibers 51, thus promoting the growth of treeing. The rubber material added to the resin base material 50 to increase the toughness has a low thermal decomposition temperature, and hence it sublimates when the electrical discharges occur. This results in voids which promote the electrical discharges. That is, the glass fibers 51 and the rubber material promote the growth of treeings caused by the electrical discharges and shortens the life of the primary spool 23.

The details of experiments conducted on the above embodiment and two comparative examples 1 and 2 are shown in FIG. 3.

In the comparative example 1, the primary spool is made by adding olefin rubber in 5 wt. % and glass fibers in 25 wt. % to PBT. However, no silica is added. In the comparative example, the primary spool is made by adding olefin rubber in 5 wt. % and silica in 25 wt. % to PBT. However, no glass fibers are added. Both examples are constructed to have the same ignition coil device diameter (25 mm) as the above embodiment.

Because no silica is added in the comparative example 1, the speed of growth of treeing in the primary spool cannot be restricted and hence the primary spool is led to the dielectric breakdown in a short period of time. On the other hand, in the comparative example 2, because silica is added, the speed of growth of treeing in the primary spool is slowed down. However, because no glass fibers are added, the primary spool is likely to plastically deform. Cracks actually occurs.

According to the above embodiment, however, glass fibers 51, rubber material and silica are added to the resin base material 50 to increase the toughness of the primary spool 23 by restricting its plastic deformation. As a result, the growth of trees arising from the erosion is restricted, and the life of the primary spool 23 is improved. With the secondary spool 20 being constructed in the same composition as the primary spool 23, the growth of trees in the secondary spool 20 is also restricted, even if electrical discharges occurs between the secondary coil 21 and a low voltage part existing inside the secondary coil 21 and erosions occur in the secondary spool 20.

In the above embodiment, the resin base material 50 for the primary spool 23 is not limited to PBT, but may be any resin as long as it is of the type which has a low melting viscosity and a high flowability. The diameter and the length of the glass fibers 51 added to the resin base material 50 to restrict plastic deformation are not limited. However, it is advantageous to add the glass fibers 51 in more than 10 wt. %, preferably 15 wt. %, so that the primary spool 23 has a mechanical rigidity sufficient to withstand the force applied during a coil winding operation. The rubber material is preferably added in more than 5 wt. % to ensure toughness.

Further, size of granules of silica added to restrict the growth of treeing is not limited. However, it is important to maintain a weight ratio between the weights of the added silica and the added glass fibers 51, that is, added silica weight divided by added glass fiber weight. It is found that the growth of trees is restricted and the life of the primary spool 23 is increased, as the weight ratio increases closely to 1. The life of the primary spool 23 does not change so much, if the weight ratio exceeds 1. Therefore, it is preferred to add the glass fibers 51 and the silica in substantially the same weight amount.

Figure 4:
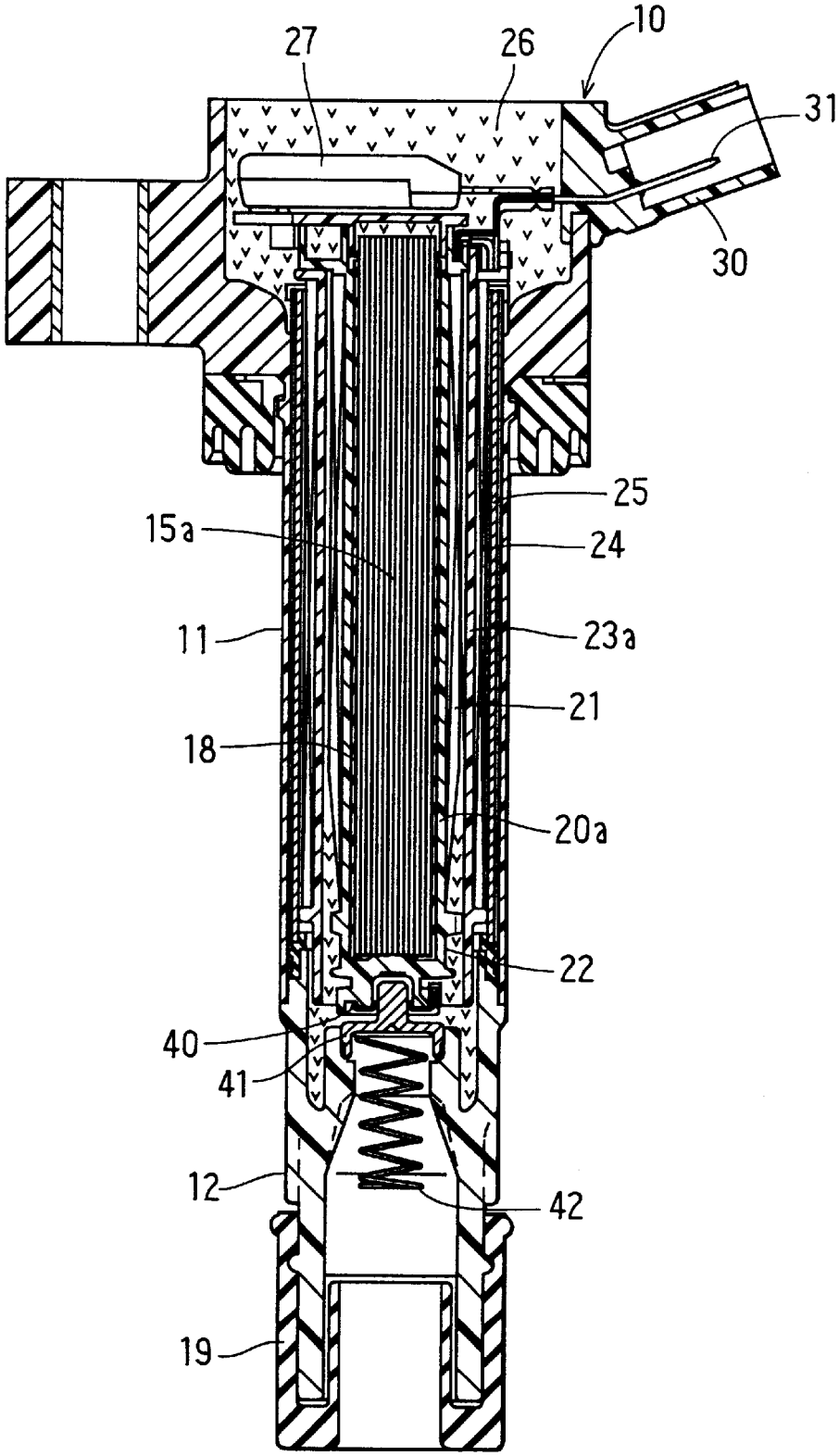
FIG. 4 is a sectional view showing an ignition coil device according to a modification of the embodiment of FIG. 1.

The above embodiment may be modified as shown in FIG. 4 in which the same or similar reference numerals designate the same or similar parts. In this modification, no permanent magnets are disposed at the top and bottom axial ends of a central core 15*a*. Although the magnetic flux generated in the primary coil 24 is decreased, the decrease is compensated for by increasing the diameter of the central core 15*a* than in the first embodiment. Thus, the secondary coil 21 is enabled to generate a required high voltage.

Unless the diameter of the plug hole is not increased, the diameter of the ignition coil device 10 is not allowed to be increased in correspondence with the increase in the central core 15*a*. Thus, it is inevitable to decrease the diameter of either of the members or the thickness of the same. It is only possible to thin spools 20*a*, 23*a* from the various constraints imposed on the ignition coil device 10 to satisfy the required performance and characteristics.

In the modification shown in FIG. 4, the primary spool 23*a* is made of the same materials as the primary spool 23 in the embodiment shown in FIGS. 1 and 2, but is more thinned than in the above embodiment. Because the thinned primary spool 23*a* is still capable of restricting the growth of trees, the life of the primary spool 23*a* and hence of the ignition coil device 10 is increased. A secondary spool 20*a* may be made of the same materials as the primary spool 23*a*, and may be more thinned than the secondary spool 20 in the above embodiment.

In the above embodiment and modification, the primary spool 23, 23*a* may be made without the rubber material. Further, the secondary spool 20, 20 may be made without silica, as long as the secondary spool 20, 20*a* is located inside the primary spool 23, 23*a*. If the secondary spool 20, 20*a* is located outside the primary spool 23, 23*a*, however, at least the secondary spool 20, 20*a* must include the glass fibers 51, rubber material and silica in addition to the resin base material 50. The primary spool 23, 23*a* may have the same composition as the secondary spool 20, 20*a*, or it need not include silica. That is, it is preferred that the spool include the glass fibers 51, rubber material and silica in addition to the resin base material 50, as long as it is disposed between the primary coil 24 and the secondary coil 21. Further, it is necessary that at least one of the primary spool 23, 23*a* and the secondary spool 20, 20*a* includes the glass fibers 51, rubber material and silica in addition to the resin base material 50.

Further, the PET, silicone or wax used as the separating material 62 may be eliminated, and instead a thin film made of PET may be wound around the primary spool 23 as the separating material. Still further, no separating material may be used for the primary coil 24.

The present invention should not be limited to the disclosed embodiment and its modifications, but may be implemented in many other ways without departing from the spirit of the invention.

What is claimed is:

1. An ignition coil device for engines comprising:

a casing;

a stick-type core disposed in the casing;

a primary spool disposed coaxially with the core in the casing;

a primary coil wound around the primary spool;

a secondary spool disposed coaxially with the core in the casing;

a secondary coil wound around the secondary spool; and a resinous insulating material filling the casing, wherein one of the spools is made of a resin base material admixed with glass fibers and silica, wherein said one of the spools is disposed between the primary coil and the secondary coil, whereby the silica restricts growth of treeing, caused by electrical discharge between the primary coil and the secondary coil, in said one of the spools.

2. An ignition coil device as in claim 1, further comprising:

a separating material disposed between the one of the spools and one of the coils wound on the one of the spools to enable thermal expansions and contractions of one radial side including the one of the spools and of another radial side including the one of the coils separately from each other.

3. An ignition coil device as in claim 2, wherein:

the separating material is a coating layer provided on an outer peripheral surface of an electrical wire body of the one of the coils.

4. An ignition coil device as in claim 2, wherein the separating material is selected from the group consisting of PET (polyethylene terepthalate), silicone and wax.

5. An ignition coil device as in claim 2, wherein the separating material comprises a thin film wound around the outer periphery of said one of the spools.

6. An ignition coil device as in claim 5, wherein said thin film is made of PET.

7. An ignition coil device as in claim 1, wherein:

said one of the spools is a primary spool and;

the secondary spool and the secondary coil are disposed radially inside the primary spool.

8. An ignition coil device as in claim 1, wherein the glass fibers and the silica are added in substantially in a same weight percent.

9. An ignition coil device as in claim 1, wherein:

the silica is admixed in about 12.5 wt. %.

10. An ignition coil device of claim 1, wherein:

the resin base material is a polybutylene terepthalate.

11. An ignition coil device as in claim 1, wherein the glass fibers are admixed in more than 10 wt. %.

12. An ignition coil device as in claim 1, wherein:

the glass fibers are admixed in about 12.5 wt. %.

13. An ignition coil device as in claim 1, wherein the glass fibers and the silica are admixed in about the same weight percent as each other.

14. An ignition coil device as in claim 1, wherein the glass fibers and the silica together total less than 50 wt. %.

15. An ignition coil device as in claim 1, wherein:

the resin base material is further admixed with a rubber material.

16. An ignition coil device as in claim 15, wherein the rubber material is added in more than 5 wt. %.

17. An ignition coil device for engines comprising:

a stick-type core disposed in the casing;

a primary spool disposed coaxially with the core in the casing;

a primary coil wound around the primary spool;

a secondary spool disposed coaxially with the core and radially inside the primary spool in the casing;

a secondary coil wound around the secondary spool and disposed adjacent to the primary coil; and a resinous insulating material filling a space between the primary spool and the primary coil, wherein the primary spool includes a mixture of a resin material, glass fibers and silica, the glass fibers and the silica being added in substantially the same wt. %.

18. An ignition coil device of claim 17, wherein:

the primary spool further includes a rubber material added in a wt. % ratio lower than that of the glass fibers and the silica.

19. An ignition coil device of claim 17, further comprising:

a coating layer provided between an electrical wire body of the primary coil and the resinous insulating material to enable the wire body and the primary spool to thermally expand and contract independently of each other.

20. An ignition coil device as in claim 17, wherein the glass fibers and the silica together total less than 50 wt. %.

21. An ignition coil device for engines comprising:

a casing;

a stick-type core disposed in the casing;

a primary spool disposed coaxially with the core in the casing;

a primary coil wound around the primary spool;

a secondary spool disposed coaxially with the core in the casing;

a secondary coil wound around the secondary spool; and a resinous insulating material filling the casing, wherein one of the spools is made of a resin base material admixed with glass fibers and silica, wherein said one of the spools is disposed between the primary coil and the second coil, and wherein the resin base material is a polybutylene terepthalate.

22. An ignition coil device as in claim 21, wherein the glass fibers and the silica are admixed in about the same weight percent as each other.

23. An ignition coil device as in claim 21, wherein the glass fibers and the silica together total less than 50 wt. %.

24. An ignition coil device for engines comprising:

a casing;

a stick-type core disposed in the casing;

a primary spool disposed coaxially with the core in the casing;

a primary coil wound around the primary spool;

a secondary spool disposed coaxially with the core in the casing;

a secondary coil wound around the secondary spool; and a resinous insulating material filling the casing; and wherein at least one of the spools is made of a resin base material admixed with glass fibers and silica, and wherein the glass fibers are admixed in about 12.5 wt. %.

25. An ignition coil device for engines comprising:

a casing;

a stick-type core disposed in the casing;

a primary spool disposed coaxially with the core in the casing;

a primary coil wound around the primary spool;

a secondary spool disposed coaxially with the core in the casing;

a secondary coil wound around the secondary spool; and a resinous insulating material filling the casing, wherein at least one of the spools is made of a resin base material admixed with glass fibers and silica, and wherein the silica is admixed in about 12.5 wt. %.

* * * * *